US012209347B2

(12) United States Patent
Liu et al.

(10) Patent No.: US 12,209,347 B2
(45) Date of Patent: Jan. 28, 2025

(54) AUTOMATIC DISPENSING DEVICE OF WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Miao Liu, Shandong (CN); Bencai Huang, Shandong (CN); Jingde Li, Shandong (CN); Bingheng Zhou, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 805 days.

(21) Appl. No.: 17/425,406

(22) PCT Filed: Jan. 16, 2020

(86) PCT No.: PCT/CN2020/072364
§ 371 (c)(1),
(2) Date: Jul. 23, 2021

(87) PCT Pub. No.: WO2020/151557
PCT Pub. Date: Jul. 30, 2020

(65) Prior Publication Data

US 2021/0388554 A1 Dec. 16, 2021

(30) Foreign Application Priority Data

Jan. 25, 2019 (CN) ..... 201910072615.8
Jan. 25, 2019 (CN) ..... 201910073152.7

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

U.S. PATENT DOCUMENTS

2004/0000177 A1 1/2004 Maeng

FOREIGN PATENT DOCUMENTS

CN 1465802 A 1/2004
CN 106436190 A 2/2017
(Continued)

OTHER PUBLICATIONS

International Search Report (PCT/ISA/210) with translation and Written Opinion (PCT/ISA/237) mailed on Apr. 22, 2020, by the Chinese Patent Office as the International Searching Authority for International Application No. PCT/CN2020/072364. ( 8 pages).

*Primary Examiner* — Jason Y Ko
(74) *Attorney, Agent, or Firm* — BUCHANAN, INGERSOLL & ROONEY PC

(57) ABSTRACT

An automatic dispensing device of a washing machine includes an accommodating cavity capable of moving between an opening position and a closing position; an additive box in the accommodating cavity and for storing an additive; an ejection structure corresponding to the additive box arranged at a bottom of the accommodating cavity; and a buffering structure corresponding to the ejection structure on an inner side of the bottom of the accommodating cavity. By arranging the ejection structure at the bottom of the accommodating cavity, a user can disassemble the additive box at the bottom manually, and replacement is easy. Through the buffering structure corresponding to the ejection structure, collision caused when the additive box is mounted in or disassembled from the accommodating cavity is effectively reduced, and the circumstance that liquid in the
(Continued)

accommodating cavity flows out from the ejection structure is also avoided.

12 Claims, 3 Drawing Sheets

(56) References Cited

FOREIGN PATENT DOCUMENTS

| | | | |
|---|---|---|---|
| CN | 108729147 | A | 11/2018 |
| WO | 2018219149 | A1 | 12/2018 |

AUTOMATIC DISPENSING DEVICE OF WASHING MACHINE

TECHNICAL FIELD

The present disclosure belongs to the technical field of household appliances, and particularly relates to an automatic dispensing device of a washing machine.

BACKGROUND

With continuous increasing of the requirements of consumers for life quality, more and more families may pay great attention to easy and convenient clothes washing, so that easy operation in the clothes washing process is particularly important in the development process of the washing machine, application of an automatic dispensing device is more and more extensive, and the requirements for the automatic dispensing device are also gradually increased. An existing automatic dispensing device needs a user to buy and manually add a detergent, some special clothes such as wool and down coats are prone to being damaged by a general detergent, the user cannot buy the special detergent easily in the using process, and the detergent is inconvenient to replace; for an addition type automatic dispensing device, the user buys a detergent and a softener by himself or herself, and different types of detergents may cause chemical reactions to influence the washing effect; a detergent adding opening is opened, so that the detergent deteriorates and mildews easily and leaks easily when the washing machine is inclined during maintenance to result in secondary quality problems. An addition type dispensing device is not easy to clean, and the detergent is solidified to easily block a releasing opening after the addition type dispensing device is used for a long time; and in addition, an additive box pushing and bouncing device is complex in structure and relatively poor in economy, so that an additive box is irregular in shape and small in volume, and the experience is affected.

A Chinese patent with the application number of CN201520021880.0 discloses a washing machine which comprises a shell, a detergent box, a button and a driving mechanism, wherein the shell is provided with a detergent box accommodating groove; the detergent box is arranged in the detergent box accommodating groove, and the detergent box is provided with a front panel; the button is arranged on the front panel; and one part of the driving mechanism is integrally connected to a back surface of the button, and the driving mechanism is configured to drive the detergent box to be away from the shell of the washing machine to pull the detergent box to be away from the shell of the washing machine when a user presses the button on the front panel.

A Chinese patent with the application number of CN201620835756.2 discloses a detergent box assembly of a washing machine and a washing machine, belongs to the technical field of washing machines, and solves the technical problem that an existing detergent box assembly is inconvenient to operate. The detergent box assembly of the utility model comprises a detergent box, a distribution box arranged in the detergent box in a sliding mode, and a water inlet assembly arranged on an upper portion of the detergent box, and further comprises a hydraulic damper, a locking device and an elastic element, wherein the locking device is arranged on the water inlet assembly or the detergent box, the hydraulic damper is mounted on the water inlet assembly, the locking device is used for locking the distribution box at a closed position, the elastic element is used for driving the distribution box to be unlocked and then ejecting the detergent box, and a damping force is provided through the hydraulic damper in the ejecting process of the distribution box.

Although the technical solution of automatic releasing of the additive box is provided in the prior art, in the using process, the addition type automatic dispensing device still has problems that the user needs to buy the general detergent by himself or herself, the detergent is inconvenient to replace and add, and the general detergent is prone to damaging high-grade fabric. Due to the opening, the detergent deteriorates and mildews and leaks easily when the washing machine is inclined during maintenance to result in secondary quality problems; the addition type dispensing apparatus is not easy to clean, and the dispensing opening is easy to block; and the pushing and bouncing device of the pushing and bouncing type additive box dispensing device is complex in structure and relatively poor in economy to result in the problems that the additive box is irregular in shape and small in volume, and the experience is affected.

Therefore, defects and drawbacks in the prior art need to be improved, and an automatic dispensing device of a washing machine is provided. An ejection structure is arranged at a bottom of an accommodating cavity, so that a user can disassemble an additive box at the bottom manually; an ejection opening is formed in a drawer below the accommodating cavity, which is simple and reliable in structure, and is at a hidden position, so that a regular, square and attractive appearance of the accommodating cavity may be guaranteed, a volume of the accommodating cavity may be utilized to the maximum extent, and the replacement is easy. Meanwhile, through a buffering structure corresponding to the ejection structure, the problem of collision caused when the additive box is mounted in or disassembled from the accommodating cavity is effectively reduced, and the circumstance that liquid in the accommodating cavity flows out from the ejection structure is also avoided. In addition, a lifting structure is arranged between the accommodating cavity and the additive box, so that the additive box may be disassembled from the accommodating cavity by pulling the lifting structure by a user; the lifting structure is arranged in a direct gap between the accommodating cavity and the additive box, which is simple and reliable in structure, and is at a hidden position. Meanwhile, the lifting structure is detachably connected with a top of the additive box, so that scratching caused when the lifting structure is switched between the opening position and the closing position of the accommodating cavity is avoided; and in addition, the accommodating cavity is a sealed space, so that liquid in the accommodating cavity is prevented from flowing out of a gap or an opening to avoid polluting the internal or external environment of the washing machine.

In view of this, the present disclosure is proposed.

SUMMARY

The technical problem to be solved by the present disclosure is to overcome the defects in the prior art and to provide an automatic dispensing device of a washing machine, which can solve the above problems or at least partially solve the above problems.

In order to solve the above technical problems, the present disclosure adopts the basic conception of a technical solution as follows: an automatic dispensing device of a washing machine comprising, an accommodating cavity, being arranged in the washing machine, and capable of moving between an opening position and a closing position;

an additive box, being arranged in the accommodating cavity for storing an additive;

an ejection structure, being arranged at a bottom of the accommodating cavity corresponding to the additive box; and a buffering structure, being arranged on an inner side of the bottom of the accommodating cavity corresponding to the ejection structure.

When the additive box is disassembled, the accommodating cavity is pulled out from the washing machine until reaching the opening position, a force from an outside to an inside of the accommodating cavity is applied to a position of the ejection structure at the bottom of the accommodating cavity, and the additive box is ejected out of the accommodating cavity, so that disassembly of the additive box is achieved.

Moreover, the ejection structure is arranged at a position close to one side of a front end of the accommodating cavity.

In one embodiment, a distance between the ejection structure and the front end of the accommodating cavity is calculated from the center of a shape of the ejection structure or an edge close to one side of the front end of the accommodating cavity; and in one embodiment, a ratio of the distance between the ejection structure and the front end of the accommodating cavity to a length of the additive box is between 1:5-1:3.

Meanwhile, the ejection structure is of a hole-shaped structure arranged at the bottom of the accommodating cavity.

In one embodiment, the ejection structure may be in a shape of a circular hole or an elongated hole extending in a placing direction of the additive box.

Further, the ejection structure is provided with a guiding structure which facilitates the search for the ejection structure at the bottom of the accommodating cavity and further applies a force.

In one embodiment, the guiding structure forms a transition surface from the outside to the inside of the accommodating cavity.

In one embodiment, the transition surface comprises an inclined surface arranged from the outside to the inside of the accommodating cavity along the periphery of the ejection structure or a smooth curved surface arranged from the outside to the inside of the accommodating cavity along the periphery of the ejection structure.

Moreover, the buffering structure is arranged around the ejection structure and is of an elastic hollow structure.

In one embodiment, the buffering structure is of a closed-loop structure arranged around the ejection structure. And, in one embodiment, the buffering structure is made of a rubber material.

Further, the buffering structure is arranged in a stacked manner in an ejection direction of the ejection structure to form an elastic hollow structure with wrinkles.

Moreover, the ejection structure is a circular through hole formed in the bottom of the accommodating cavity; or an elongated through hole extending in the bottom of the accommodating cavity in the placing direction of the additive box.

Moreover, the ejection structure is a circular hole formed in the bottom of the accommodating cavity; or an elongated hole extending in the bottom of the accommodating cavity in the placing direction of the additive box.

In one embodiment, an elastic film is arranged on the ejection structure; and the film can deform under the action of pressure.

Further, deformation of the film comprises deformation from the inside to the outside of the accommodating cavity when the additive box is mounted; and deformation when a force is applied from the outside to the inside of the accommodating cavity during disassembly of the additive box.

An automatic dispensing device of a washing machine comprising, an accommodating cavity moving between an opening position and a closing position;

an additive box being arranged in the accommodating cavity for storing an additive; and a lifting structure at least partially arranged around the additive box, wherein during disassembly of the additive box, the additive box is taken out from an opening in a top of the accommodating cavity located at the opening position by pulling the lifting structure.

The lifting structure comprises a first lifting portion, a second lifting portion and a third lifting portion which are sequentially connected and have flexibility;

the first lifting portion is arranged in a space between the additive box and the bottom of the accommodating cavity;

the second lifting portion is arranged in a space between the additive box and at least one side wall of the accommodating cavity;

the third lifting portion is connected with the second lifting portion and is bent towards a side close to the addive box.

In one embodiment, the second lifting portion is arranged in a space between the additive box and a front wall of the accommodating cavity.

In one embodiment, the lifting structure is approximately of a laterally placed U-shaped structure.

Further, the third lifting portion is provided with a clamping hole, and a buckle is arranged on the additive box and corresponds to the clamping hole; after the additive box is mounted in the accommodating cavity, the third lifting portion is connected with the additive box by matching the clamping hole with the buckle.

In one embodiment, the lifting structure is made of a flexible material; and in one embodiment, the lifting structure is made of a PET material.

Moreover, the first lifting portion is connected with the additive box; during mounting, the first lifting portion faces one side of the bottom of the accommodating cavity; and in one embodiment, the first lifting portion is connected with the additive box through the clamping hole and the buckle.

Meanwhile, the first lifting portion is fixedly connected with the bottom of the accommodating cavity; and during mounting, after the additive box is completely placed in the accommodating cavity, the clamping hole of the third lifting portion is connected with the buckle of the additive box.

After the technical solution is adopted, compared with the prior art, the present disclosure has the following beneficial effects:

1. The ejection structure is arranged at the bottom of the accommodating cavity, so that a user can disassemble the additive box at the bottom manually, an ejection opening is formed in a drawer below the accommodating cavity, which is simple and reliable in structure, and is at the hidden position, so that a regular, square and attractive appearance of the accommodating cavity may be guaranteed, a volume of the accommodating cavity may be utilized to the maximum extent, and the accommodating cavity is easy to replace.

2. Through the buffering structure corresponding to the ejection structure, the problem of collision caused when the additive box is mounted in or disassembled from the accommodating cavity is effectively reduced, and the circumstance that liquid in the accommodating cavity flows out from the ejection structure is also avoided.

3. The lifting structure is arranged between the accommodating cavity and the additive box, so that the user may disassemble the additive box from the accommodating cavity by pulling the lifting structure.

4. The lifting structure is arranged in the gap between the accommodating cavity and the additive box, which is simple and reliable in structure, and is at the hidden position, meanwhile, the lifting structure is detachably connected with the top of the additive box, and scratching caused when the lifting structure is switched between the opening position and the closing position of the accommodating cavity is avoided.

5. The accommodating cavity is a sealed space, so that the liquid in the accommodating cavity is prevented from flowing out from the gap or the opening to avoid polluting the internal or external environment of the washing machine. Specific embodiments of the present disclosure are described further in detail below with reference to the accompanying drawings.

BRIEF DESCRIPTION OF THE DRAWINGS

The accompanying drawings, which are part of the present disclosure, serve to provide a further understanding of the present disclosure, and illustrative embodiments of the present disclosure and descriptions thereof serve to explain the present disclosure, but do not constitute an undue limitation of the present disclosure. Obviously, the accompanying drawings in the following description are merely some embodiments, and those of ordinary skill in the art can obtain other accompanying drawings according to these accompanying drawings without inventive effort.

In the drawing.

In the figures, 1—accommodating cavity; 2—additive box; 201—buckle; 3—ejection structure; 4—buffering structure; 5—lifting structure; 501—first lifting portion; 502—second lifting portion; 503—third lifting portion; and 504—clamping hole.

It should be noted that these accompanying drawings and the written description are not intended to limit the scope of the inventive concept in any way, but rather to illustrate the inventive concept for those skilled in the art by reference to specific embodiments.

DETAILED DESCRIPTION

In order to make the objects, technical solutions and advantages of the embodiments of the present disclosure clearer, the technical solutions in the embodiments will be clearly and completely described below with reference to the accompanying drawings in the embodiments of the present disclosure, and the following embodiments are used for illustrating the present disclosure and are not intended to limit the scope of the present disclosure.

In the description of the present disclosure, it should be noted that the terms "upper", "lower", "front", "rear", "left", "right", "vertical", "inner", "outer" and the like indicate orientations or positional relationships based on the orientations or positional relationships shown in the accompanying drawings, and are only for convenience of the description of the present disclosure and simplification of the description, but do not indicate or imply that the device or element referred to must have a specific orientation, be constructed and operated in a specific orientation, and thus, should not be construed as limiting the present disclosure.

In the description of the present disclosure, it should be noted that, unless otherwise explicitly specified and limited, the terms "mount", "couple", and "connect" are to be understood broadly, for example, "connect" may be fixed connection, detachable connection, or integral connection; may be mechanical or electrical connection; and may be direct connection or indirect connection through an intermediate. Those of ordinary skill in the art may understand the specific meanings of the above terms in the present disclosure according to specific cases.

Figure 1:
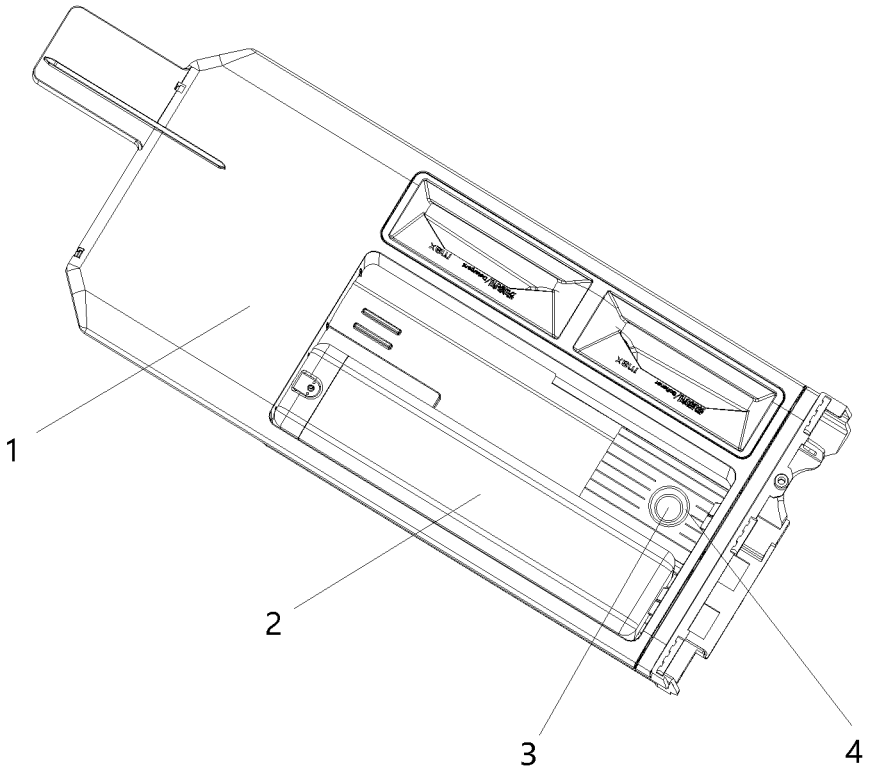
FIG. 1 is a first axonometric diagram of an automatic dispensing device of the present disclosure.
Figure 2:
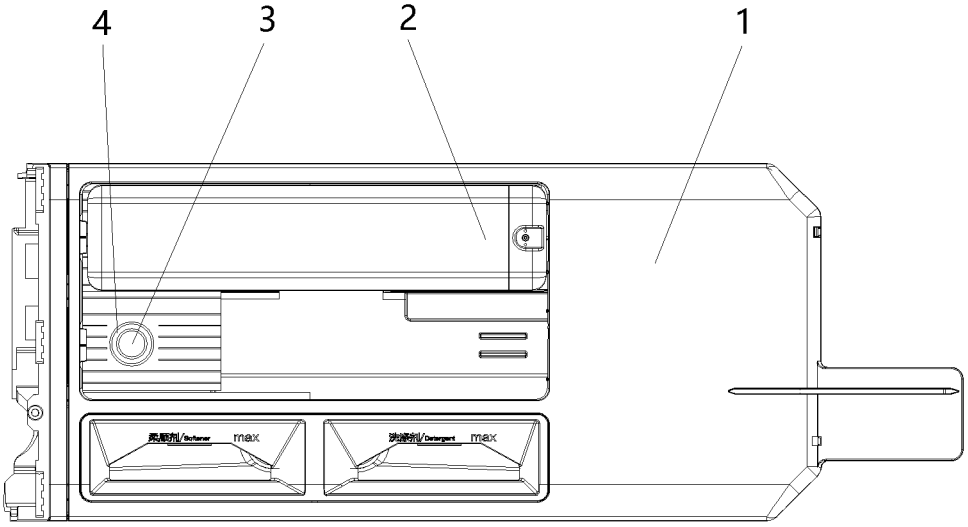
FIG. 2 is a top view of the automatic dispensing device of the present disclosure.

FIG. 1 is a first axonometric diagram of an automatic dispensing device of the present disclosure, and an automatic dispensing device of a washing machine is mainly shown from the perspective of the axonometric diagram. It can be seen in FIG. 1 that a space for accommodating an additive box 2 is formed in an accommodating cavity 1, and at least two positions in the accommodating cavity 1 are used for mounting the additive box 2. Of course, the number of the additive box 2 is only used for enabling those skilled in the art to better understand the technical solution of the present disclosure, and in practical application, the number of the additive box 2 is not limited and is not an inventive point of the prevent disclosure. Further, an ejection structure 3 is arranged at a bottom of the accommodating cavity 1, corresponds to a position of the additive box 2, and is arranged at a position close to a front end of the accommodating cavity 1. The accommodating cavity 1 has an opening position and a closing position, when the additive box 2 needs to be disassembled, the accommodating cavity 1 is adjusted to the opening position, a user finds out the position where the ejection structure 3 is located from an outer side of the bottom of the accommodating cavity 1, the additive box 2 is ejected out by applying a force from an outside to an inside of the accommodating cavity 1, and then disassembly of the additive box 2 is achieved. In addition, a buffering structure 4 is further arranged corresponding to the ejection structure 3 in the present disclosure, when the additive box 2 is mounted in the accommodating cavity 1, the buffering structure 4 may avoid hard contact between the additive box 2 and the bottom of the accommodating cavity 1, and possible damage caused by mutual collision between the accommodating cavity 1 and the additive box 2 is avoided. Meanwhile, in the using process, due to the fact that the accommodating cavity 1 has the circumstance that water enters the accommodating cavity 1 to, for example, dilute washing powder or clean the accommodating cavity 1, if only the ejection structure 3 is arranged, particularly only a through hole type ejection structure 3 is arranged, there is the possibility that water in the accommodating cavity 1 flows out from the ejection structure 3 to pollute the internal or external environment of the washing machine, thereby affecting the experience of the user. In the present disclosure, the additive box 2 is of an independent structure arranged in the accommodating cavity 1 and can be taken and placed independently, and a detergent or a softener is arranged in the additive box 2. FIG. 2 is a top view of the automatic dispensing device of the present disclosure, and the automatic dispensing device is mainly shown from the perspective of the top view. The layout condition of the inside of the accommodating cavity 1 may be seen more visually in FIG. 2, and it can be seen in FIG. 2 that two accommodating positions of the additive box 2 are arranged in parallel, the ejection structure 3 is arranged at a mounting vacancy position of one additive box 2, corresponds to the additive box 2 and is close to the front end of the accommodating cavity 1, so that the user can apply a force conveniently, the opening position of the accommodating cavity 1 may be made to occupy a minimum external space to achieve disassembly of the additive box 2. Moreover, the buffering structure 4 corresponding to the ejection structure 3 can be seen more clearly in FIG. 2, when the additive box 2 is mounted in the accommodating cavity 1, due to the fact that the additive box 2 is filled with an additive such as a detergent or a softener, the additive box 2 presses the buffering structure 4 to deform under the action of gravity, and due to the fact that the buffering structure 4 is elastic, sealing is achieved well under the effect of elasticity, so that the possibility that water in the accommodating cavity 1 flows out from the ejection structure 3 to further pollute the internal or external environment of the washing machine, thereby affecting the experience of the user is avoided.

Figure 3:
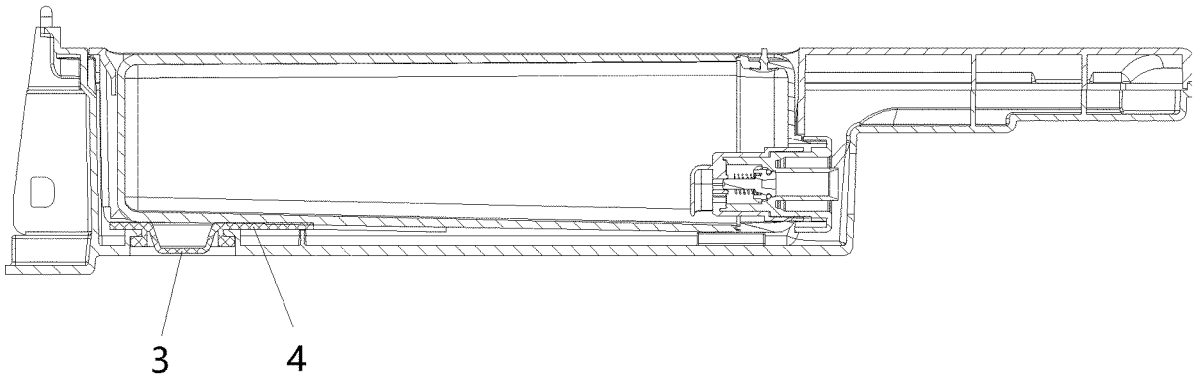
FIG. 3 is a first lateral section view of the automatic dispensing device of the present disclosure.

FIG. 3 is a first lateral section view of the automatic dispensing device of the present disclosure, and the automatic dispensing device of the present disclosure is more fully shown in the lateral section view. It can be seen that the ejection structure 3 of the present disclosure is of a hole-shaped structure arranged at the bottom of the accommodation cavity 1, and a guiding structure is provided, and thus, the user can easily find the ejection structure 3 from the accommodating cavity 1 in a labor-saving and time-saving manner. Although FIG. 3 shows only one technical solution of the ejection structure 3, in practical application, the shape of the ejection structure 3 has multiple variants, the practical situation and the requirements of different customers are fully considered, for example, some users are poor in finger feeling or do not have sufficient strength. Multiple variants of the technical solution of the ejection structure 3 are set to fully consider the above technical problems, and the specific technical solution is shown in the following embodiments.

Figure 4:
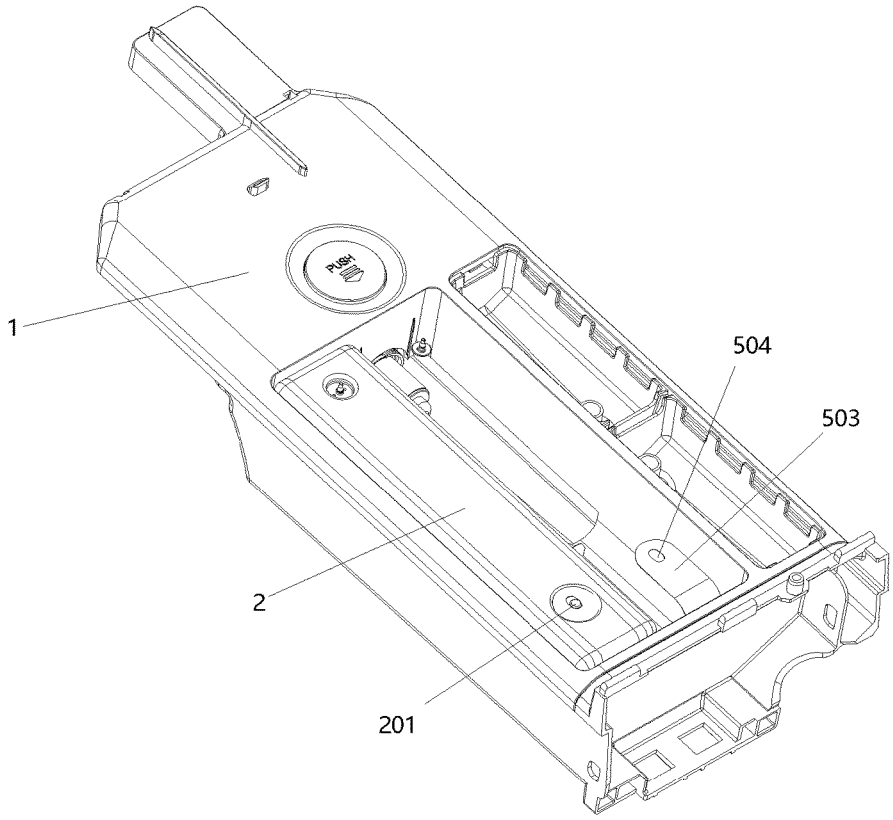
FIG. 4 is a second axonometric diagram of the automatic dispensing device of the present disclosure.

FIG. 4 is a second axonometric diagram of the automatic dispensing device of the present disclosure, and the automatic dispensing device of the washing machine of the present disclosure is mainly shown from the perspective of the axonometric diagram. It can be seen in FIG. 4 that a space for accommodating an additive box 2 is formed in an accommodating cavity 1, at least two positions for mounting the additive box 2 are reserved in the accommodating cavity 1, of course, the number of the additive box 2 is only used for enabling those skilled in the art to better understand the technical solution of the present disclosure, and in practical application, the number of the additive box 2 is not limited and is not an inventive point of the present disclosure. Further, a lifting structure 5 is arranged at least partially around the additive box 2 and corresponds to the position of the additive box 2, and the accommodating cavity 1 comprises an opening position and a closing position. When the additive box 2 is mounted, the accommodating cavity 1 is pulled out from the washing machine until reaching the opening position, the additive box 2 filled with an additive is placed in the accommodating cavity 1, and the accommodating cavity 1 is pushed into the washing machine until reaching the closing position; when the additive box 2 is disassembled, the accommodating cavity 1 is pulled out from the washing machine until reaching the opening position, the lifting structure 5 at least partially arranged around the additive box 2 is pulled to take the additive box 2 out from an opening in the top of the accommodating cavity 1 at the opening position. In addition, the additive box 2 is further provided with a buckle 201, and the lifting structure 5 is provided with a clamping hole 504 corresponding to the buckle 201. When the additive box 2 is mounted in the accommodating cavity 1, the buckle 201 may be buckled with the clamping hole 504 to achieve buckling of the lifting structure 5 and the additive box 2, thereby avoiding the circumstance that when the accommodating cavity 1 moves between the opening position and the closing position, scratching is caused by the turnup lifting structure 5 to affect the use of a user, and potential safety hazards caused by equipment damage are caused. The additive box 2 is of an independent structure arranged in the accommodating cavity 1, can be taken and placed independently, and internally contains a detergent or a softener.

Figure 5:
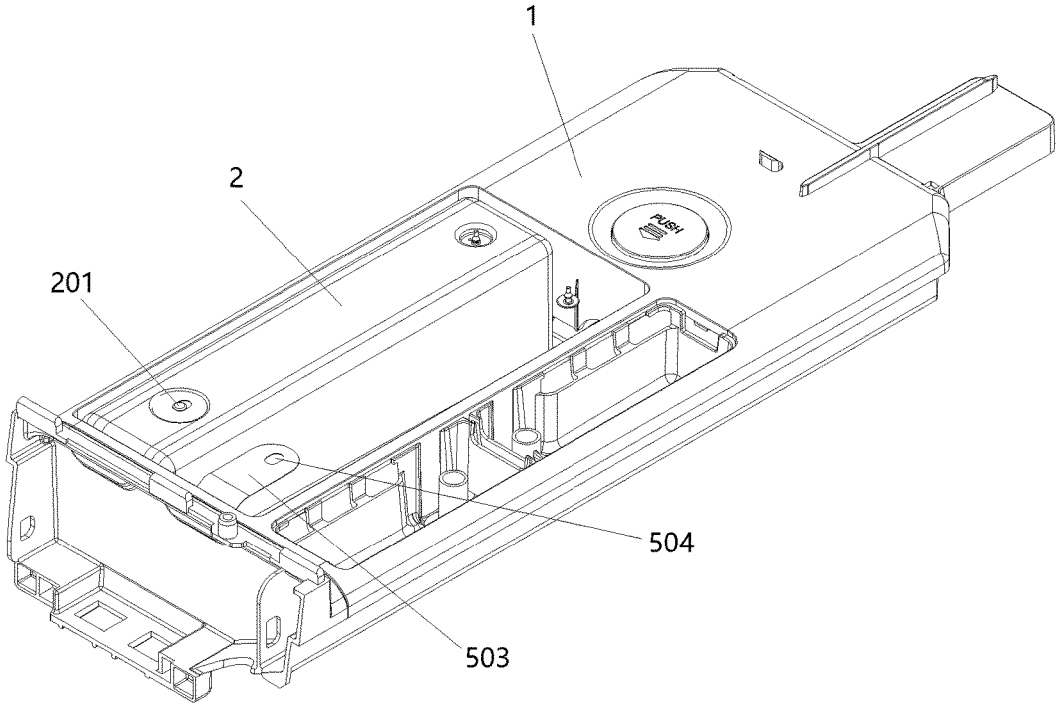
FIG. 5 is a third axonometric diagram of the automatic dispensing device of the present disclosure.

FIG. 5 is a third axonometric diagram of the automatic dispensing device of the present disclosure, and the automatic dispensing device of the present disclosure is mainly shown from the perspective of the axonometric diagram. The layout condition of the inside of the accommodating cavity 1 may be more visually seen in FIG. 5, and it can be seen in FIG. 5 that the accommodating positions of two additive boxes 2 are arranged in parallel. The lifting structure 5 is arranged at a mounting vacancy position of one additive box 2, the additive box 2 is omitted here in order to make those skilled in the art better understand the lifting structure 5 of the present disclosure, and the lifting structure 5 may be removed or hidden here.

Figure 6:
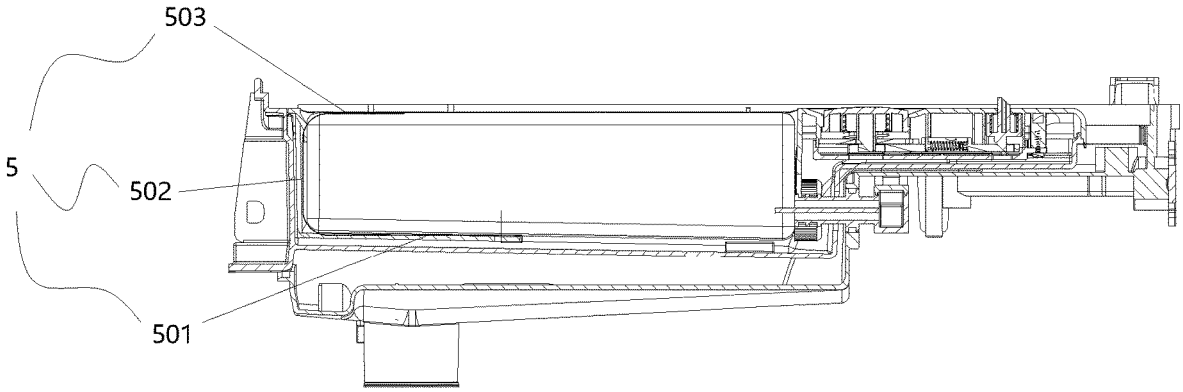
FIG. 6 is a second lateral section view of the automatic dispensing device of the present disclosure.

FIG. 6 is a second lateral section view of the automatic dispensing device of the present disclosure, and the automatic dispensing device of the present disclosure is more fully shown in the lateral section view. It can be seen that the lifting structure 5 of the present disclosure is at least partially arranged around the additive box 2 in the accommodating cavity 1, the additive box 2 is omitted in the figure in order to make those skilled in the art better understand the lifting structure 5 of the present disclosure, and the lifting structure 5 may be removed or hidden. Further, the lifting structure 5 is of a laterally placed U-shaped structure and comprises a first lifting portion 501, a second lifting portion 502 and a third lifting portion 503 which are sequentially connected. When the additive box 2 is disassembled, the user pulls the third lifting portion 503 to achieve disassembly of the additive box 2 and removal of the additive box 2 from the accommodating cavity 1, and the specific technical solution is shown in the following embodiment.

In the present disclosure, the ejection structure 3 is arranged at the bottom of the accommodating cavity 1, so that the user can disassemble the additive box at the bottom manually, an ejection opening is formed in a drawer at a bottom of the accommodating cavity 1, which is simple and reliable in structure, and is at a hidden position, so that a regular, square and attractive appearance of the the accommodating cavity 1 may be guaranteed, a volume of the accommodating cavity 1 may be utilized to the maximum extent, and replacement is easy. Through the buffering structure 4 arranged corresponding to the ejection structure 3, the problem of collision caused when the additive box is mounted in or disassembled from the accommodating cavity 1 is effectively reduced, and the circumstance that liquid in the accommodating cavity 1 flows out from the ejection structure 3 is also avoided.

In addition, the lifting structure 5 is arranged between the accommodating cavity 1 and the additive box, so that the additive box may be disassembled from the accommodating cavity 1 by pulling the lifting structure 5 by the user. The lifting structure 5 is arranged in a gap between the accommodating cavity 1 and the additive box, which is simple and reliable in structure, and is at a hidden position. Meanwhile, the lifting structure 5 is detachably connected with the top of the additive box, so that scratching caused when the lifting structure 5 is switched between the opening position and the closing position of the accommodating cavity 1 is avoided; and the accommodating cavity 1 is a sealed space, so that liquid in the accommodating cavity 1 is prevented from flowing out from a gap or an opening to avoid polluting the internal or external environment of the washing machine. When applied to specific embodiments, the automatic dispensing device is as described below.

In a specific embodiment, as shown in FIG. 1 to FIG. 3, an automatic dispensing device of a washing machine of the present embodiment comprises an accommodating cavity 1 arranged inside the washing machine and capable of moving between an opening position and a closing position; an additive box 2 arranged in the accommodating cavity 1 for storing an additive; an ejection structure 3 corresponding to the additive box 2 and arranged at a bottom of the accommodating cavity 1; and a buffering structure 4 corresponding to the ejection structure 3 and arranged on an inner side of the bottom of the accommodating cavity 1. FIG. 1 is a first axonometric diagram of the automatic dispensing device of the present disclosure, and the automatic dispensing device of the washing machine is mainly shown from the perspective of the axonometric diagram. It can be seen in FIG. 1 that a space for accommodating the additive box 2 is formed in the accommodating cavity 1, and at least two positions for mounting the additive box 2 are reserved in the accommodating cavity 1; of course, the number of the additive box 2 is only used for enabling those skilled in the art to better understand the technical solution of the present disclosure, and in practical application, the number of the additive box 2 is not limited and is not an inventive point of the present disclosure. Further, the ejection structure 3 is arranged at the bottom of the accommodating cavity 1, corresponds to the position of the additive box 2, and is arranged at the position close to the front end of the accommodating cavity 1. The accommodating cavity 1 has the opening position and the closing position, when the additive box 2 needs to be disassembled, the accommodating cavity 1 is adjusted to the opening position, a user finds the position where the ejection structure 3 is located from the outer side of the bottom of the accommodating cavity 1, the additive box 2 is ejected out by applying a force from the outside to the inside of the accommodating cavity 1 to achieve disassembly of the additive box 2. In addition, the buffering structure 4 is further arranged corresponding to the ejection structure 3, when the additive box 2 is mounted in the accommodating cavity 1, the buffering structure 4 may avoid hard contact between the additive box 2 and the bottom of the accommodating cavity 1, and possible damage caused by mutual collision between the accommodating cavity 1 and the additive box 2 is avoided. Meanwhile, in the using process, due to the circumstance that water enters the accommodating cavity 1 to, for example, dilute washing powder or clean the accommodating cavity 1, if only the ejection structure 3 is arranged, particularly only a through hole type ejection structure 3 is arranged, there is the possibility that water in the accommodating cavity 1 flows out from the ejection structure 3 to pollute the internal or external environment of the washing machine, thereby affecting the experience of the user.

When the additive box 2 is disassembled, the accommodating cavity 1 is pulled out from the washing machine until reaching the opening position, a force from the outside to the inside of the accommodating cavity 1 is applied to the position of the ejection structure 3 at the bottom of the accommodating cavity 1 to eject the additive box 2 out of the accommodating cavity 1, thereby achieving disassembly of the additive box 2.

Further, the ejection structure 3 is arranged at the position close to one side of the front end of the accommodating cavity 1, and further, a distance between the ejection structure 3 and the front end of the accommodating cavity 1 is calculated from the center of the shape of the ejection structure 3 or an edge close to one side of the front end of the accommodating cavity 1.

According to the preferred technical solution of the embodiment, a ratio of the distance between the ejection structure 3 and the front end of the accommodating cavity 1 to a length of the additive box 2 is between 1:5-1:3.

In a specific embodiment, as shown in FIG. 1 to FIG. 3, according to the automatic dispensing device of the washing machine of the present embodiment, the ejection structure 3 is of a hole-shaped structure arranged at the bottom of the accommodating cavity 1, and the ejection structure 3 is in the shape of a circular hole or an elongated hole extending in a placing direction of the additive box 2. The ejection structure 3 is provided with a guiding structure which facilitates the search for the ejection structure 3 at the bottom of the accommodating cavity 1 and further applies a force; the guiding structure forms a transition surface from the outside to the inside of the accommodating cavity 1; the transition surface comprises an inclined surface which is arranged along the periphery of the ejection structure 3 from the outside to the inside of the accommodating cavity 1 or a smooth curved surface which is arranged along the periphery of the ejection structure 3 from the outside to the inside of the accommodating cavity 1. FIG. 3 is a lateral section view of the automatic dispensing device of the present disclosure, the automatic dispensing device of the present disclosure is more fully shown in the lateral section view, and it can be seen that the ejection structure 3 of the present disclosure is of the hole-shaped structure arranged at the bottom of the accommodating cavity 1 and is further provided with the guiding structure, so that a user conveniently finds the ejection structure 3 in the accommodating cavity 1 in a labor-saving and time-saving manner. Although FIG. 3 only shows the technical solution of the ejection structure 3, in practical application, the shape of the ejection structure 3 has multiple variants, and the practical situation and the requirements of different customers are fully considered, for example, some users are poor in finger feeling or do not have insufficient strength; multiple varients of the technical solution of the ejection structure 3 are set to fully consider the above technical problems, and the specific technical solution is shown in the following embodiments.

Further, the buffering structure 4 is arranged around the ejection structure 3, and is of an elastic hollow structure, the buffering structure 4 is of a closed-loop structure arranged around the ejection structure 3, the buffering structure 4 arranged corresponding to the ejection structure 3 may be seen more clearly in FIG. 2. When the additive box 2 is mounted in the accommodating cavity 1, due to the fact that the additive box 2 is filled with an additive such as a detergent or a softener, under the action of gravity, the additive box 2 presses the buffering structure 4 to deform, and due to the fact that the buffering structure 4 has elasticity, sealing is well achieved under the action of elasticity, so that the possibility that water in the accommodating cavity 1 flows out from the ejection structure 3 to pollute the internal or external environment of the washing machine, thereby affecting the experience of the user is avoided.

As a preferred technical solution of the embodiment, the buffering structure 4 is made of a rubber material.

In a specific embodiment, the buffering structure 4 of the embodiment is arranged in a stacked manner from an ejection direction of the ejection structure 3 to form an elastic hollow structure with wrinkles, and due to the wrinkle-shaped structure, the buffering space of the buffering structure 4 may be larger, and meanwhile, the sealing effect is better.

In a specific embodiment, the ejection structure 3 in the embodiment is a circular through hole formed in the bottom of the accommodating cavity 1, or is an elongated through hole extending in the bottom of the accommodating cavity 1 in the placing direction of the additive box 2.

In a specific embodiment, the ejection structure 3 of the embodiment is a circular hole formed in the bottom of the accommodating cavity 1, or is an elongated hole extending in the bottom of the accommodating cavity 1 in the placing direction of the additive box 2; further, an elastic film is arranged on the ejection structure 3; the film can deform under the action of pressure; and deformation of the film comprises deformation from the inside to the outside of the accommodating cavity 1 when the additive box 2 is mounted and deformation when a force is applied from the outside to the inside of the accommodating cavity 1 during disassembly of the additive box 2.

In a specific embodiment, a using method of the automatic dispensing device of the washing machine of the embodiment comprises the steps: when the additive box 2 is mounted, the accommodating cavity 1 is pulled out from the washing machine until reaching the opening position, the additive box 2 with the additive is placed in the accommodating cavity 1, and the accommodating cavity 1 is pushed into the washing machine until reaching the closing position; and when the additive box 2 is disassembled, the accommodating cavity 1 is pulled out from the washing machine until reaching the opening position, a force is applied to the position of the ejection structure 3 at the bottom of the accommodating cavity 1 to eject the additive box 2 out of the accommodating cavity 1, thereby disassembling the additive box 2.

In a specific embodiment, as shown in FIG. 4 to FIG. 6, an automatic dispensing device of a washing machine of the embodiment comprises an accommodating cavity 1 moving between an opening position and a closing position; an additive box 2 for storing an additive and arranged in the accommodating cavity 1; and a lifting structure 5 at least partially arranged around the additive box 2, wherein when the additive box 2 is disassembled, the additive box 2 is taken out from an opening in a top of the accommodating cavity 1 at the opening position by pulling the lifting structure 5. FIG. 4 is a second axonometric diagram of the automatic dispensing device of the present disclosure, and the automatic dispensing device of the washing machine of the present disclosure is mainly shown from the perspective of the axonometric diagram. It can be seen in FIG. 1 that a space for accommodating the additive box 2 is formed in the accommodating cavity 1, and at least two positions for mounting the additive box 2 are reserved in the accommodating cavity 1; of course, the number of the additive box 2 is only used for enabling those skilled in the art to better understand the technical solutions of the present disclosure, and in practical application, the number of the additive box 2 is not limited and is not an inventive point of the present disclosure. Further, the lifting structure 5 is arranged at least partially around the additive box 2 and corresponds to the position of the additive box 2, and the accommodating cavity 1 has an opening position and a closing position. When the additive box 2 is mounted, the accommodating cavity 1 is pulled out from the washing machine until reaching the opening position, the additive box 2 with the additive is placed in the accommodating cavity 1, and the accommodating cavity 1 is pushed into the washing machine until reaching the closing position; when the additive box 2 is disassembled, the accommodating cavity 1 is pulled out from the washing machine until reaching the opening position, the lifting structure 5 at least partially arranged around the additive box 2 is pulled, the additive box 2 is taken out from the opening in the top of the accommodating cavity 1 at the opening position. In addition, the additive box 2 is further provided with a buckle 201, and the lifting structure 5 is provided with a clamping hole 504 corresponding to the buckle 201. When the additive box 2 is mounted in the accommodating cavity 1, the buckle 201 can be buckled with the clamping hole 504 to achieve buckling of the lifting structure 5 and the additive box 2, thereby avoiding the circumstance that when the accommodating cavity 1 moves between the opening position and the closing position, scratching is caused by the turnup lifting structure 5 to affect the use of the user is not affected, and potential safety hazards are caused by equipment damage.

The lifting structure 5 comprises a first lifting portion 501, a second lifting portion 502 and a third lifting portion 503 which are sequentially connected and have flexibility. The first lifting portion 501 is arranged in a space between the additive box 2 and the bottom of the accommodating cavity 1; the second lifting portion 502 is arranged in a space between the additive box 2 and at least one side wall of the accommodating cavity 1; and the third lifting portion 503 is connected with the second lifting portion 502 and is bent towards a side close to the additive box 2. The second lifting portion 502 is arranged in a space between the additive box 2 and the front wall of the accommodating cavity 1. The lifting structure 5 is approximately of a laterally placed U-shaped structure.

As a preferred scheme of the embodiment, the lifting structure 5 is made of a PET material.

In a specific embodiment, as shown in FIG. 4 to FIG. 6, according to the automatic dispensing device of the washing machine of the embodiment, the clamping hole 504 is formed in the third lifting portion 503, and the buckle 201 is arranged on the additive box 2 and corresponds to the clamping hole 504. After the additive box 2 is mounted in the accommodating cavity 1, the third lifting portion 503 is matched with the buckle 201 through the clamping hole 504, so that the third lifting portion 503 is connected with the additive box 2; and the lifting structure 5 is made of a flexible material.

FIG. 5 is a third axonometric diagram of the automatic dispensing device of the present disclosure, and the automatic dispensing device is mainly shown from the perspective of the axonometric diagram. The layout condition of the inside of the accommodating cavity 1 may be more visually seen in FIG. 5, and it can be seen in FIG. 5 that the accommodating positions of the two additive boxes 2 are arranged in parallel; and the lifting structure 5 is arranged at a mounting vacancy position of one additive box 2, and the additive box 2 is omitted in the figure in order to make those skilled in the art better understand the lifting structure 5 of the present disclosure, and the lifting structure 5 may be removed or hidden.

FIG. 6 is a second lateral section view of the automatic dispensing device of the present disclosure, and the automatic dispensing device of the present disclosure is more fully shown in the lateral section view. It can be seen that the lifting structure 5 of the present disclosure at least partially arranged around the additive box 2 is arranged in the accommodating cavity 1, the additive box 2 is omitted in the figure in order to make those skilled in the art to better understand the lifting structure 5, and the lifting structure 5 may be removed or hidden. Further, the lifting structure 5 is of a laterally placed U-shaped structure and comprises the first lifting portion 501, the second lifting portion 502 and the third lifting portion 503 which are sequentially connected. When the additive box 2 is disassembled, the user pulls the third lifting portion 503 to achieve disassembly of the additive box 2 to take the additive box 2 out from the accommodating cavity 1, and the specific technical solution is shown in the following embodiment.

As a preferred technical solution of the embodiment, the lifting structure 5 is made of a PET material.

In a specific embodiment, as shown in FIG. 4 to FIG. 6, the first lifting portion 501 of the embodiment is connected to the additive box 2; during mounting, the first lifting portion 501 faces one side of the bottom of the accommodating cavity 1; and the first lifting portion 501 is connected with the additive box 2 through the clamping hole 504 and the buckle 201.

In a specific embodiment, as shown in FIG. 4 to FIG. 6, the first lifting portion 501 of the embodiment is fixedly connected to the bottom of the accommodating cavity 1; and during mounting, after the additive box 2 is completely placed into the accommodating cavity 1, the clamping hole 504 of the third lifting portion 503 is connected with the buckle 201 of the additive box 2.

In a specific embodiment, a using method of the automatic dispensing device of the washing machine comprises the following steps: when the additive box 2 is mounted, the accommodating cavity 1 is pulled out from the washing machine until reaching the opening position, the additive box 2 with the additive is placed in the accommodating cavity 1, and the accommodating cavity 1 is pushed into the washing machine until reaching the closing position; and when the additive box 2 is disassembled, the accommodating cavity 1 is pulled out from the washing machine until reaching the opening position, the lifting structure 5 at least partially arranged around the additive box 2 is pulled, and the additive box 2 is taken out from the opening in the top of the accommodating cavity 1 at the opening position.

FIG. 4 is a second axonometric diagram of the automatic dispensing device of the prevent disclosure, and the automatic dispensing device of the washing machine is mainly shown from the perspective of the axonometric diagram. It can be seen in FIG. 4 that a space for accommodating the additive box 2 is formed in the accommodating cavity 1, and at least two positions for mounting the additive box 2 are reserved in the accommodating cavity 1; and of course, the number of the additive box 2 is only used for enabling those skilled in the art to better understand the technical solutions of the present disclosure, and in practical application, the number of the additive box 2 is not limited and is not an inventive point of the disclosure. Further, the lifting structure 5 is arranged at least partially around the additive box 2 and corresponds to the position of the additive box 2, and the accommodating cavity 1 comprises the opening position and the closing position. When the additive box 2 is mounted, the accommodating cavity 1 is pulled out from the washing machine until reaching the opening position, the additive box 2 with the additive is placed in the accommodating cavity 1, and the accommodating cavity 1 is pushed into the washing machine until reaching the closing position; and when the additive box 2 is disassembled, the accommodating cavity 1 is pulled out from the washing machine until reaching the opening position, the lifting structure 5 at least partially arranged around the additive box 2 is pulled, and the additive box 2 is taken out from the opening in the top of the accommodating cavity 1 at the opening position. In addition, the additive box 2 is further provided with the buckle 201, and the lifting structure 5 is provided with the clamping hole 504 corresponding to the buckle 201. When the additive box 2 is mounted in the accommodating cavity 1, the buckle 201 may be buckled with the clamping hole 504 to achieve buckling of the lifting structure 5 and the additive box 2, thereby avoiding the circumstance that when the accommodating cavity 1 moves between the opening position and the closing position, scratching is caused by the turnup lifting structure 5 to affect the use of the user, and potential safety hazards are caused by equipment damage.

The description provided here sets forth numerous specific details. However, it is understood that the embodiments of the present disclosure may be practiced without these specific details. In some instances, well-known methods, structures and techniques have not been shown in detail in order not to obscure the understanding of this description.

Moreover, those skilled in the art will appreciate that although some embodiments described herein include some features included in other embodiments, not others, combinations of features of different embodiments are also meant to be within the scope of protection of the present disclosure and form different embodiments. For example, in the above embodiments, those skilled in the art can use the present disclosure in a combined manner according to the technical solutions and technical problems to be solved by the present application.

The above is only preferred embodiments of the present disclosure and is not intended to limit the present disclosure in any form, and while the present disclosure has been disclosed in the preferred embodiments but is not intended to limit the present disclosure, any skilled person who is familiar with the patent can make changes or modifications to form equivalent embodiments with equivalent changes by utilizing the above suggestive technical content without departing from the scope of the technical solutions of the present disclosure, any simple amendments, equivalent changes and modifications of the above embodiments according to the technical essence of the present disclosure without departing from the content of the technical solutions still belong to the scope of the solution of the present disclosure.

The invention claimed is:

1. An automatic dispensing device of a washing machine, comprising:

an accommodating cavity arranged in the washing machine, and capable of moving between an opening position and a closing position;

an additive box arranged in the accommodating cavity for storing an additive;

an ejection structure, corresponding to the additive box and arranged at a bottom of the accommodating cavity; and a buffering structure, corresponding to the ejection structure, and arranged on an inner side of the bottom of the accommodating cavity.

2. The automatic dispensing device of the washing machine according to claim 1, wherein when the additive box is disassembled, the accommodating cavity is pulled out from the washing machine to the opening position, a force from an outside to an inside of the accommodating cavity is applied to a position of the ejection structure at the bottom of the accommodating cavity to eject the additive box out of the accommodating cavity, thereby achieving disassembly of the additive box.

3. The automatic dispensing device of the washing machine according to claim 1, wherein the ejection structure is arranged close to a front end of the accommodating cavity;

a distance between the ejection structure and the front end of the accommodating cavity is calculated from a center of a shape of the ejection structure or an edge close to the front end of the accommodating cavity; and a ratio of the distance between the ejection structure and the front end of the accommodating cavity to a length of the additive box is between 1:5-1:3.

4. The automatic dispensing device of the washing machine according to claim 1, wherein the ejection structure is of a hole-shaped structure arranged at the bottom of the accommodating cavity; and the ejection structure is in a shape of a circular hole or an elongated hole extending in a placing direction of the additive box.

5. The automatic dispensing device of the washing machine according to claim 4, wherein the ejection structure is provided with a guiding structure which facilitates a search for the ejection structure at the bottom of the accommodating cavity and further applies a force;

the guiding structure forms a transition surface from outside to inside of the accommodating cavity; and the transition surface comprises an inclined surface arranged from the outside to the inside of the accommodating cavity along a periphery of the ejection structure or a smooth curved surface arranged from outside to inside of the accommodating cavity along the periphery of the ejection structure.

6. The automatic dispensing device of the washing machine according to claim 1, wherein the buffering structure is arranged around the ejection structure and is of an elastic hollow structure.

7. The automatic dispensing device of the washing machine according to claim 6, wherein the buffering structure is arranged in a stacked manner from an ejection direction of the ejection structure to form an elastic hollow structure with wrinkles.

8. The automatic dispensing device of the washing machine according to claim 1, wherein the ejection structure is a circular through hole formed in the bottom of the accommodating cavity; or an elongated through hole extending in the bottom of the accommodating cavity in a placing direction of the additive box.

9. The automatic dispensing device of the washing machine according to claim 1, wherein the ejection structure is a circular hole formed in the bottom of the accommodating cavity; or an elongated hole extending in the bottom of the accommodating cavity in a placing direction of the additive box.

10. The automatic dispensing device of the washing machine according to claim 9, wherein deformation of the film comprises deformation from inside to outside of the accommodating cavity when the additive box is mounted; and deformation when force is applied from outside to inside of the accommodating cavity during disassembly of the additive box.

11. The automatic dispensing device of the washing machine according to claim 6, wherein the buffering structure is of a closed-loop structure arranged around the ejection structure; and the buffering structure is made of a rubber material.

12. The automatic dispensing device of the washing machine according to claim 9, wherein an elastic film is arranged on the ejection structure; and the film can deform under an action of pressure.

* * * * *